US009239565B2

(12) United States Patent
Tsuritani et al.

(10) Patent No.: US 9,239,565 B2
(45) Date of Patent: Jan. 19, 2016

(54) POWDER CONTAINER, DEVELOPING UNIT, PROCESS UNIT, AND IMAGE FORMING APPARATUS INCORPORATING SAME

(71) Applicants: Shoh Tsuritani, Osaka (JP); Yoshiyuki Shimizu, Osaka (JP); Tomohiro Kubota, Osaka (JP); Manabu Hamada, Osaka (JP); Masato Tsuji, Osaka (JP)

(72) Inventors: Shoh Tsuritani, Osaka (JP); Yoshiyuki Shimizu, Osaka (JP); Tomohiro Kubota, Osaka (JP); Manabu Hamada, Osaka (JP); Masato Tsuji, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/079,812

(22) Filed: Nov. 14, 2013

(65) Prior Publication Data

US 2014/0153972 A1 Jun. 5, 2014

(30) Foreign Application Priority Data

Dec. 4, 2012 (JP) ..... 2012-265337

(51) Int. Cl.
*G03G 15/08* (2006.01)
*G03G 21/18* (2006.01)

(52) U.S. Cl.
CPC ..... *G03G 21/18* (2013.01); *G03G 15/0886* (2013.01)

(58) Field of Classification Search
USPC ..... 399/260
See application file for complete search history.

(56) References Cited

U.S. PATENT DOCUMENTS

| | | | | |
|---|---|---|---|---|
| 5,649,270 | A * | 7/1997 | Omata et al. | 399/262 |
| 6,438,345 | B1 * | 8/2002 | Ban et al. | 399/262 |
| 6,470,163 | B1 * | 10/2002 | Minagawa | 399/256 |
| 2004/0190945 | A1 * | 9/2004 | Yamada | 399/258 |
| 2007/0189813 | A1 * | 8/2007 | Matsumoto et al. | 399/262 |
| 2009/0232547 | A1 * | 9/2009 | Nagae et al. | 399/119 |
| 2012/0087694 | A1 * | 4/2012 | Itabashi | 399/106 |
| 2012/0189327 | A1 * | 7/2012 | Kubota et al. | 399/27 |
| 2012/0219318 | A1 * | 8/2012 | Yoshida et al. | 399/110 |
| 2012/0301187 | A1 * | 11/2012 | Ishikuro et al. | 399/262 |
| 2013/0028638 | A1 | 1/2013 | Tsuritani et al. | |
| 2013/0259532 | A1 | 10/2013 | Kubota et al. | |

FOREIGN PATENT DOCUMENTS

| | | |
|---|---|---|
| JP | 6-035321 | 2/1994 |
| JP | 11-223990 | 8/1999 |
| JP | 2012-037555 | 2/2012 |

OTHER PUBLICATIONS

U.S. Appl. No. 13/908,434, filed Jun. 3, 2013.
U.S. Appl. No. 13/944,359, filed Jul. 17, 2013.
U.S. Appl. No. 13/944,359, filed Jul. 17, 2013, Hamada, et al.

* cited by examiner

*Primary Examiner* — Rochelle-Ann J Blackman
*Assistant Examiner* — Linda B Smith
(74) *Attorney, Agent, or Firm* — Oblon, McClelland, Maier & Neustadt, L.L.P.

(57) ABSTRACT

A powder container that includes a container body to contain powder for image formation, a discharge outlet formed in the container body to discharge powder therefrom, a shutter movable between an open position to open the discharge outlet and a closed position to close the discharge outlet, and a seal member to be interposed between the container body and the shutter when the shutter is at the open position. In a state in which the shutter is at the open position, a downstream end of the seal member in an opening direction in which the shutter moves to open the discharge outlet is positioned downstream from a downstream end of the shutter in the opening direction.

20 Claims, 12 Drawing Sheets

POWDER CONTAINER, DEVELOPING UNIT, PROCESS UNIT, AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-265337, filed on Dec. 4, 2012, in the Japan Patent Office, the entire disclosure of which is hereby incorporated by reference herein.

BACKGROUND OF THE INVENTION

1. Technical Field

The present invention generally relates to a powder container for containing powder used for image formation; and a developing unit, a process unit, and an image forming apparatus, such as, a copier, a printer, a facsimile machine, a plotter, the like, or a multifunction machine (or multifunction peripheral) having at least two of capabilities of copying, printing, plotting, scanning, facsimile transmission, and the like, that includes the powder container.

2. Description of the Background Art

In electrophotographic image forming apparatuses, typically a powder container (e.g., a toner cartridge) for containing powder for forming images, such as powdered toner or developer, is provided separately from a process unit including a photoreceptor, a developing roller, and the like to facilitate maintenance work and reduce the cost of replacement components. Toner cartridges are provided with a discharge outlet to discharge toner contained therein, and the discharge outlet is detachably connectable to a supply inlet provided to the process unit, a developing device, or the like. A shutter is often provided to the discharge outlet to prevent leak of toner through the discharge outlet when the toner cartridge is dismounted from the process unit or the like. For example, JP-H11-223990-A proposes such a configuration.

SUMMARY OF THE INVENTION

In view of the foregoing, one embodiment of the present invention provides a powder container that includes a container body to contain powder for image formation, a discharge outlet formed in the container body to discharge powder therefrom, a shutter movable between an open position to open the discharge outlet and a closed position to close the discharge outlet, and a seal member to be interposed between the container body and the shutter being at the open position. The seal member is designed so that, in a state in which the shutter is at the open position, a downstream end of the seal member in an opening direction in which the shutter moves to open the discharge outlet is positioned downstream from a downstream end of the shutter in the opening direction.

Another embodiment provides a developing unit that includes a developing device to supply powder for image formation to a latent image formed on a latent image bearer, and the above-described powder container.

Yet another embodiment provides a process unit removably installable in an apparatus body of an image forming apparatus. The process unit includes the latent image bearer, and the developing device, and the powder container described above.

Yet another embodiment provides an image forming apparatus that includes the latent image bearer, the powder container, and the developing device. In the image forming apparatus, the powder container may be formed as an independent unit. Alternatively, the powder container may be united with the developing device into the developing unit or united with the latent image bearer and the developing device into the process unit.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
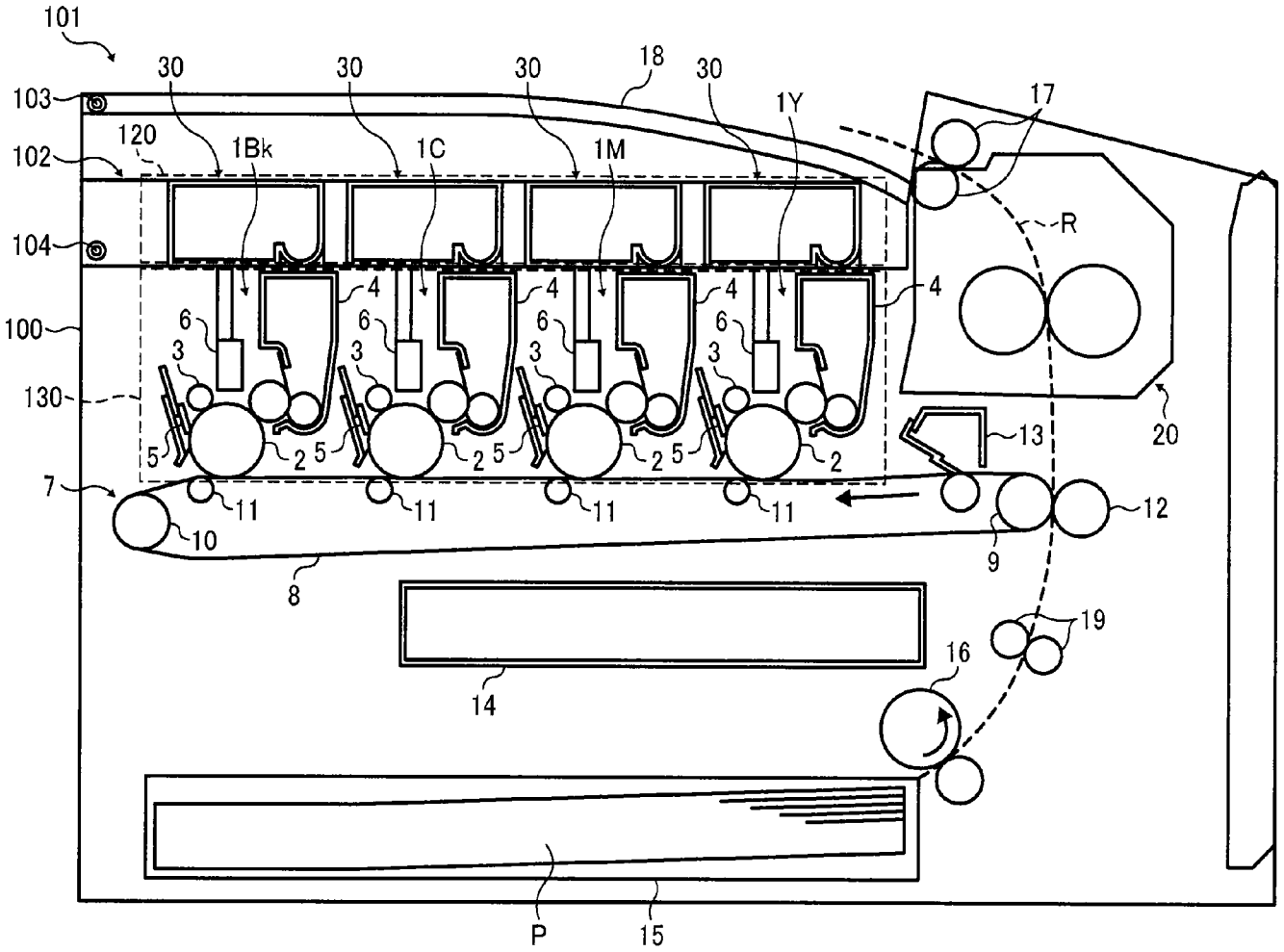
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

For example, the image forming apparatus shown in FIG. 1 is a printer. However, embodiments of the present invention are not limited thereto. Alternatively, the image forming apparatus to which various aspects of this specification are applied can be single-color or multicolor printers of other types, copiers, facsimile machines, or multifunction machines having these capabilities.

In an image forming apparatus shown in FIG. 1, four process units 1Y, 1M, 1C, and 1Bk are removably installed in an apparatus body 100 thereof. The process units 1Y, 1M, 1C, and 1Bk respectively contain yellow (Y), magenta (M), cyan (C), and black (Bk) toners (i.e., developers) corresponding to decomposed color components of full-color images and have a similar configuration except the color of toner contained therein.

More specifically, each process unit 1 includes a drum-shaped photoreceptor 2 serving as a latent image bearer or image bearer, a charging roller 3 serving as a charging device to charge a surface of the photoreceptor 2, a developing device 4 to supply toner to a latent image formed on the photoreceptor 2, and a cleaning blade 5 serving as a cleaning member to clean the surface of the photoreceptor 2. Additionally, exposure devices 6 are disposed facing the respective photoreceptors 2. The exposure devices 6 serve as latent image forming devices to form latent images on the surfaces of the photoreceptors 2. In the present embodiment, a light-emitting diode (LED) unit is used as the exposure device 6.

Additionally, a toner cartridge 30 serving as a powder container is provided above each developing device 4 and removably connected thereto. Each toner cartridge 30 contains toner whose color is identical to that contained in the corresponding developing device 4. When the amount of toner stored in the developing device 4 falls below a predetermined amount, toner is supplied from the toner cartridge 30 thereto. Although one-component developer consisting essentially of toner is used in the present embodiment, features of the present specification can adapt to configurations using two-component developer including toner (toner particles) and carrier (carrier particles).

Additionally, a transfer device 7 is provided beneath the photoreceptors 2. The transfer device 7 includes an intermediate transfer belt 8 serving as an intermediate transfer member or image bearer onto and from which an image is transferred. The intermediate transfer belt 8 can be, for example, an endless belt. The intermediate transfer belt 8 is stretched around support rollers, namely, a driving roller 9 and a driven roller 10. As the driving roller 9 rotates counterclockwise in FIG. 1, the intermediate transfer belt 8 rotates.

The image forming apparatus shown in FIG. 1 further includes four primary-transfer rollers 11 positioned facing the respective photoreceptors 2 via the intermediate transfer belt 8. Each primary-transfer roller 11 is pressed against an inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage.

Additionally, a secondary-transfer roller 12 is provided at a position facing the driving roller 9 via the intermediate transfer belt 8. The secondary-transfer roller 12 is pressed against an outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

Additionally, a belt cleaning unit 13 to clean the surface of the intermediate transfer belt 8 is provided facing a right end portion of the intermediate transfer belt 8 from the outer circumferential side in FIG. 1. A waste toner conveyance hose (tube) is connected to the belt cleaning unit 13 as well as an inlet of a waste toner container 14 provided beneath the transfer device 7.

Beneath the apparatus body 100 or in a lower portion thereof, a sheet tray 15 for containing sheets P, serving as recording media, and a feed roller 16 to feed the sheets P from the sheet tray 15 are provided. The recording media include, in addition to standard copy paper, heavy paper, post cards, thin paper such as tracing paper, coated paper, art paper, and special purpose sheets. Additionally, overhead projector (OHP) sheets or films may be used as the recording media.

A pair of discharge rollers 17 is provided in an upper portion of the apparatus body 100 to discharge the sheets outside, and the discharged sheets are stacked on a discharge tray 18 formed in an upper face of the apparatus body 100.

A conveyance path R is formed inside the apparatus body 100, and the sheet P is conveyed from the sheet tray 15 to the secondary-transfer nip and further to the discharge tray 18 along the conveyance path R. Along the conveyance path R, a pair of registration rollers 19 is provided upstream from the secondary-transfer roller 12 in the direction in which the sheet P is transported (hereinafter "sheet conveyance direction"), and a fixing device 20 to fix an image on the sheet P is provided downstream from the secondary-transfer roller 12 in that direction.

Referring to FIG. 1, operation of the image forming apparatus according to the present embodiment is described below.

When image formation is started, the photoreceptors 2 in the respective process units 1 are rotated clockwise in FIG. 1, and the changing rollers 3 uniformly charge the surfaces of the photoreceptors 2 to a predetermined polarity. Then, the exposure devices 6 direct laser beams onto the charged surfaces of the respective photoreceptors 2 according to, for example, image data captured by a reading unit or transmitted from computers. Thus, electrostatic latent images are formed on the respective photoreceptors 2. More specifically, the exposure devices 6 direct the laser beams according to respective single color data, namely, yellow, cyan, magenta, and black color data decomposed from full-color image data to the surfaces of the photoreceptors 2. The electrostatic latent images formed on the photoreceptors 2 are developed into toner images with toner supplied by the respective developing devices 4.

Meanwhile, the driving roller 9 rotates, and accordingly the intermediate transfer belt 8 stretched therearound rotates. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method.

The transfer electrical fields generated in the primary-transfer nips transfer the toner images from the respective photoreceptors 2 and sequentially superimpose them one on another on the intermediate transfer belt 8. Thus, a multicolor toner image is formed on the outer surface the intermediate transfer belt 8. After primary transfer, the cleaning blades 5 remove toner remaining on the respective photoreceptors 2.

In the lower portion of the apparatus body 100, the feed roller 16 starts rotating, sending out the sheet P from the sheet tray 15 to the conveyance path R. Then, the registration rollers 19 stop the sheet P temporarily.

The registration rollers 19 start rotating at a predetermined timing to transport the sheet P to the secondary-transfer position, timed to coincide with the arrival of the toner image on the intermediate transfer belt 8. At that time, the transfer bias voltage whose polarity is opposite a toner charge polarity of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet P at a time. The belt cleaning unit 13 removes toner remaining on the intermediate transfer belt 8 (i.e., waste toner) after the image transfer, and the waste toner is collected in the waste toner container 14.

Subsequently, the sheet P is transported to the fixing device 20, where the toner image is fixed on the sheet P. Then, the pair of discharge rollers 17 discharges the sheet P onto the discharge tray 18.

It is to be noted that, although the description above concerns multicolor image formation, alternatively, single color, bicolor, and three color images may be formed using one, two, or three out of the four process units 1.

Additionally, the image forming apparatus shown in FIG. 1 further includes an upper cover 101, serving as a first cover, disposed on the upper side of the apparatus body 100 in FIG. 1 and an intermediate cover 102, serving as a second cover, disposed inside (lower than) the upper cover 101. The upper cover 101 and the intermediate cover 102 are hinged to the apparatus body 100. The upper cover 101 and the intermediate cover 102 can pivot up and down about support shafts 103 and 104, respectively, to be opened and closed with respect to the apparatus body 100.

Figure 2:
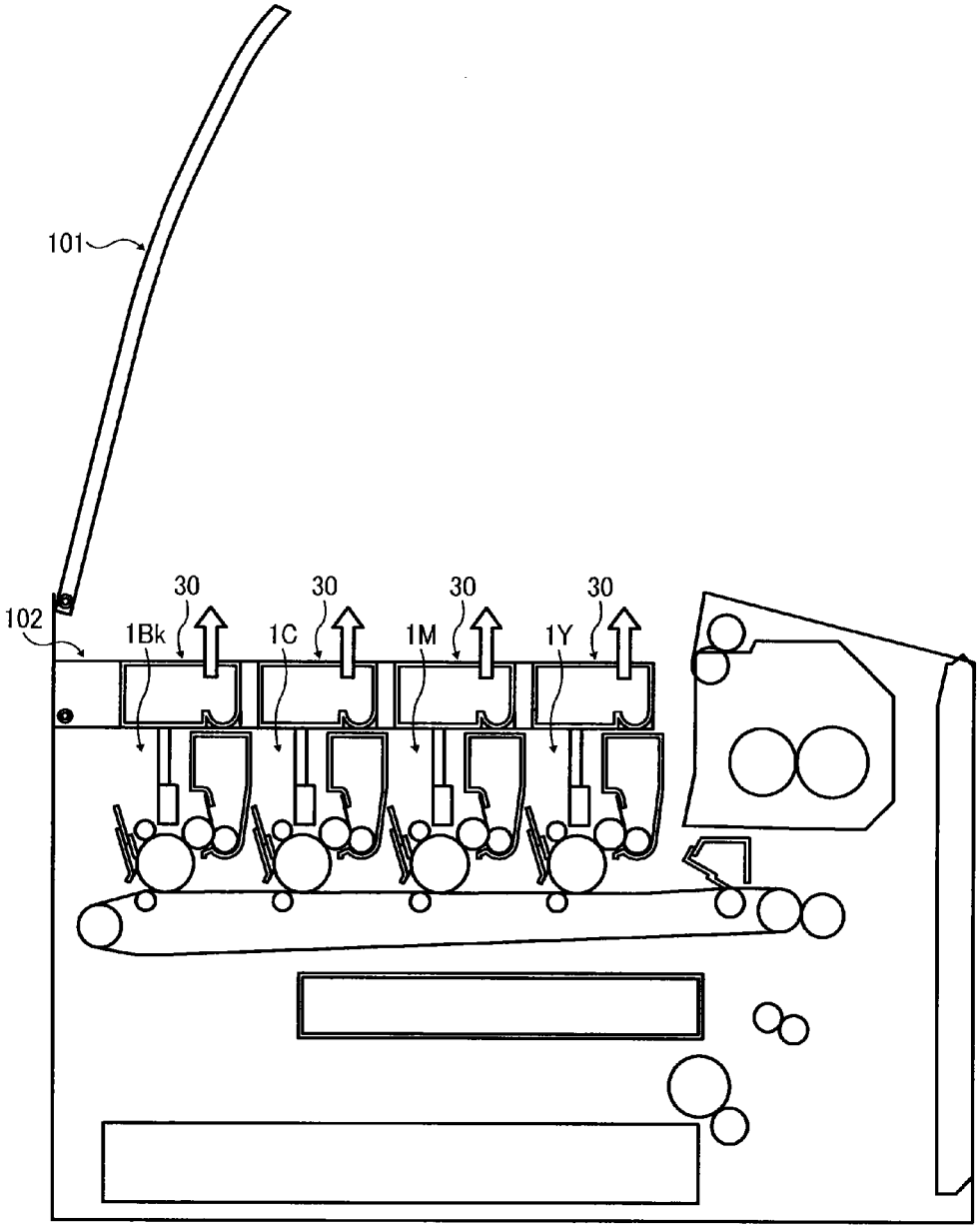
FIG. 2 is a schematic view illustrating a state in which an upper cover of the image forming apparatus shown in FIG. 1 is open.
Figure 3:
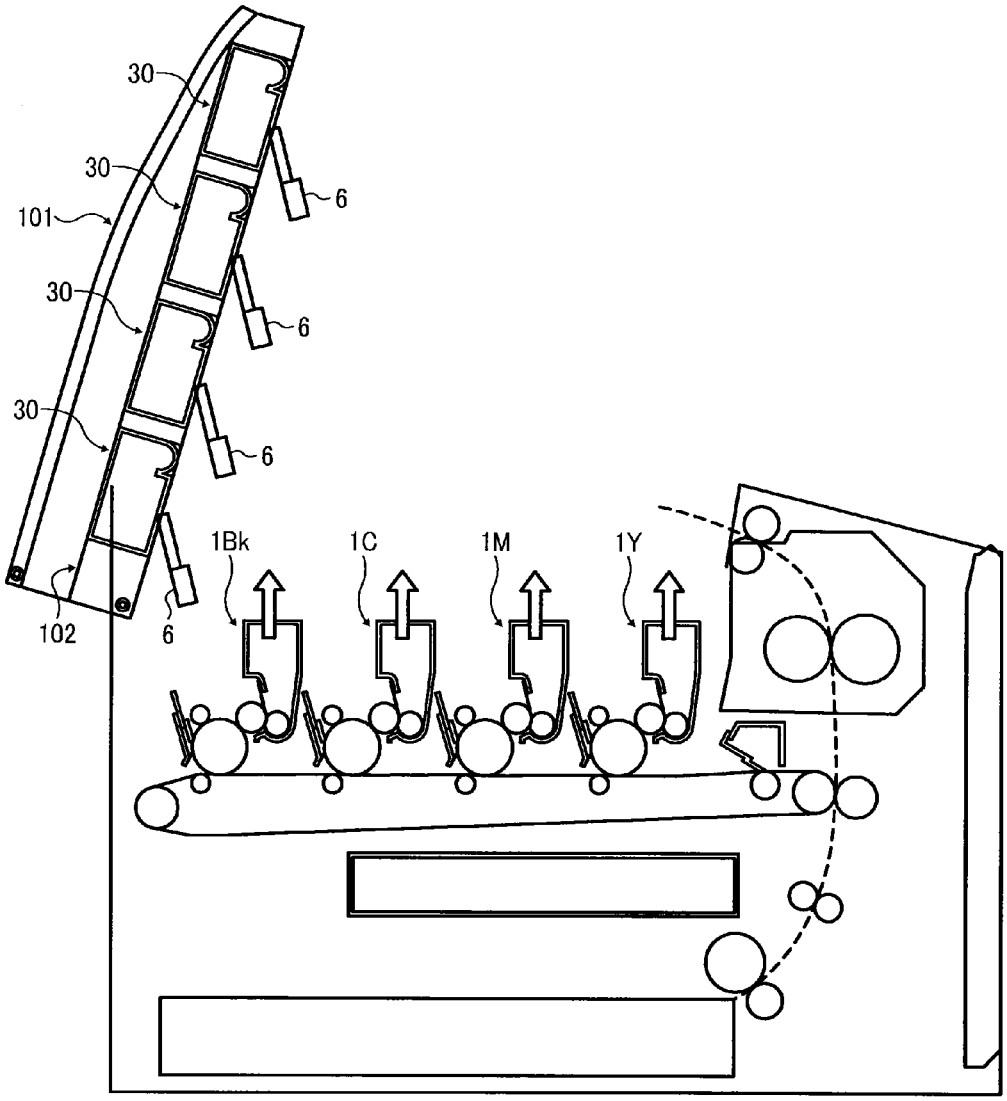
FIG. 3 is a schematic view illustrating a state in which the upper cover and an intermediate cover of the image forming apparatus shown in FIGS. 1 and 2 are open.

FIG. 2 is a schematic view illustrating a state in which the upper cover 101 is open, and FIG. 3 is a schematic view illustrating a state in which also the intermediate cover 102 is open.

The intermediate cover 102 is provided with a container mount 120 (shown in FIG. 1) in which the toner cartridges 30 are detachably mounted. Additionally, a unit mount 130 (shown in FIG. 1) is formed beneath (an the inner side of) the intermediate cover 102 to house the process units 1Y, 1M, 1C, and 1Bk.

As shown in FIG. 2, the toner cartridges 30 can be mounted to and removed from the upper cover 101 (the container mount 120) from above when the upper cover 101 is open.

Additionally, when the intermediate cover 102 is open as shown in FIG. 3, the toner cartridges 30 can be moved away from an area above the process units 1. At that time, since the exposure devices 6 are moved away from the area above the photoreceptors 2, the process units 1 can be removed from the apparatus body 100 from above. Thus, in the present embodiment, installation and removal of the process units 1 can be executed without removing the toner cartridges 30 from the intermediate cover 102, which can facilitate replacement work.

Figure 4:
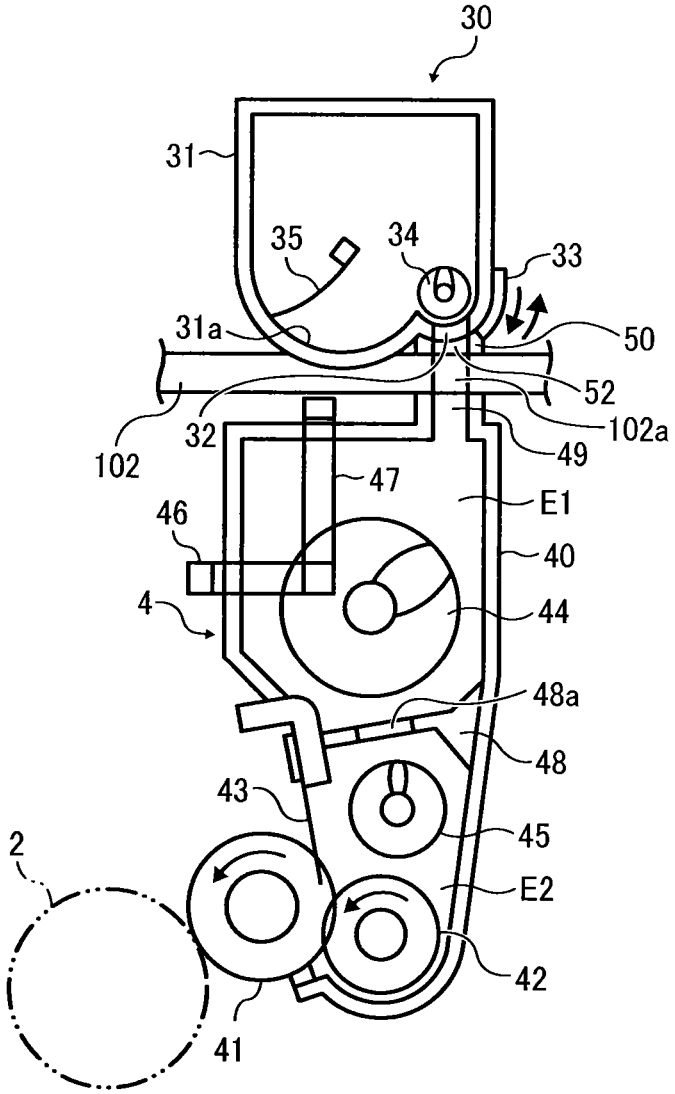
FIG. 4 is a schematic end-on axial view of a developing device and a toner cartridge according to a first embodiment.

FIG. 4 is a schematic end-on axial view of the developing device 4 and the toner cartridge 30.

As shown in FIG. 4, the developing device 4 according to the present embodiment includes a development housing 40 for containing developer, a developing roller 41 serving as a developer bearer, a supply roller 42 serving as a developer supply member to supply toner to the developing roller 41, a doctor blade 43 serving as a developer regulator to adjust the amount of toner carried on the developing roller 41, first and second developer conveying screws 44 and 45 serving as developer conveyance members to transport the developer (toner), and first and second light guides 46 and 47.

A partition 48 divides an interior of the development housing 40 into a first compartment (upper compartment) E1 and a second compartment (lower compartment) E2 arranged vertically, and an opening 48*a* is formed in either end portion of the partition 48 in the direction perpendicular to the surface of the paper on which FIG. 4 is drawn.

In the first compartment E1, the conveying screw 44 and the two light guides 46 and 47 are provided. In the second compartment E2, the conveying screw 45 and the supply roller 42 are provided. The developing roller 41 and the doctor blade 43 are provided at an opening through which the second compartment E2 faces the photoreceptor 2.

Each of the conveying screws 44 and 45 includes a rotation shaft and a spiral blade winding around the outer circumference of the rotation shaft. The conveying screws 44 and 45 are configured to transport toner axially by rotation. The screw blades thereof, however, wind in the opposite directions, and the conveying screws 44 and 45 transport toner in the opposite directions.

The developing roller 41 includes a metal core and an conductive elastic layer made of, for example, rubber, overlying the metal core. In the present embodiment, for example, the metal core has an external diameter of 6 mm, and the conductive elastic layer has an outer diameter of 12 mm and hardness HS of 75 according to Japanese Industrial Standards (JIS). Additionally, the conductive elastic layer is designed to have a volume resistivity of about $10^5\Omega$ to $10^7\Omega$. For example, conductive urethane rubber or silicone rubber may be used for the conductive elastic layer. The developing roller 41 rotates counterclockwise in FIG. 4 as indicated an arrow shown in FIG. 4 and transports developer carried thereon to a position facing the doctor blade 43 and a position facing the photoreceptor 2.

Typically, a sponge roller can be used as the supply roller 42. The sponge roller including a metal core and semiconducting foam polyurethane adhering to the metal core is suitable. Foam polyurethane can be made semiconducting by mixing carbon therein. In the present embodiment, the metal core of the supply roller 42 has an external diameter of about 6 mm, and the sponge layer has an external diameter of about 12 mm, for example. The supply roller 42 is disposed in contact with the developing roller 41. The size of the nip formed between the supply roller 42 and the developing roller 41 in contact with each other is typically about 1 mm to 3 mm. In the present embodiment, the size of the nip is 2 mm, for example.

Additionally, the supply roller 42 rotates counterclockwise in FIG. 4 as indicated by an arrow shown in FIG. 4 and can transport the toner in the development housing 40 to the outer layer of the developing roller 41 efficiently by rotating in the counter direction to the direction of rotation of the developing roller 41 at the nip therebetween. Additionally, in the present embodiment, the ratio of rotational frequency of the supply roller 42 to that of the developing roller 41 is 1 so that toner can be supplied reliably.

The doctor blade 43 can be constructed of, for example, a planar metal having a thickness of about 0.1 mm. Steel used stainless (SUS) metal may be used for the doctor blade 43. The doctor blade 43 is disposed so that its end (on a free end side) contacts a surface of the developing roller 41, forming a regulation nip.

The amount of toner carried on the developing roller 41 is adjusted for stable developability and satisfactory image quality. Accordingly, in commercial products, typically the pressure with which the doctor blade 43 contacts the developing roller 41 and the position of the regulation nip are maintained strictly. For example, the contact pressure of the doctor blade 43 against the developing roller 41 is about 20 N/m to 60 N/m, and the regulation nip is positioned about 0.5±0.5 mm from the end of the doctor blade 43. These parameters can be determined in accordance with properties of developer (toner), the developing roller, and the supply roller.

For example, in the present embodiment, the doctor blade 43 is constructed of a SUS metal having a thickness of 0.1 mm, disposed in contact with the developing roller 41 with a pressure of 45 N/m, and the regulation nip is positioned 0.2 mm from the end of the doctor blade 43. The length from a fixed end of the doctor blade 43 to the free end is 14 mm to form a uniform thin toner layer on the developing roller 41.

The light guides 46 and 47 are constructed of materials of good light permeability. For example, resins of high transparency, such as acrylic resin or polycarbonate can be used. Alternatively, optical glass having better optical characteristics may be used for the light guides 46 and 47. Yet alternatively, optical fibers may be used for the light guides 46 and 47. In this case, design flexibility of a light path formed with the light guides 46 and 47 can be improved.

An end of each of the light guides 46 and 47 is exposed outside the development housing 40. In a state in which the process unit 1 is in the apparatus body 100, the exposed end portions of the light guides 46 and 47 respectively face a light-emitting element and a light-receiving element of a toner amount detector provided to the apparatus body 100. With the light-emitting element and the light-receiving element facing the end portions of the light guides 46 and 47, respectively, a light path for guiding light from the light-emitting element to the light-receiving element through the light guides 46 and 47 can be formed. That is, the light emitted from the light-emitting element is guided to the development housing 40 by the light guide 46 and guided further to the light-receiving element by the light guide 47. The other end of the light guide 46 and the other end of the light guide 47 are disposed inside the development housing 40 and face each other across clearance of a predetermined or given size.

The toner cartridge 30 includes a container body 31 in which a powder chamber is formed, a toner outlet 32 (i.e., a discharge outlet) formed in the container body 31, a shutter 33 to open and close the toner outlet 32, a conveying screw 34, and an agitator 35. The agitator 35 agitates toner inside the container body 31, and the conveying screw 34 transports the toner to the toner outlet 32.

The conveying screw 34 includes a rotation shaft and a spiral blade winding around the outer circumference of the rotation shaft. The agitator 35 includes a rotation shaft parallel to the rotation shaft of the conveying screw 34 and a deformable planar blade provided to the rotation shaft. For example, the blade of the agitator 35 can be formed with a flexible material such as polyethylene terephthalate film. Additionally, when a bottom face 31*a* of the container body 31 is curved into an arc in conformity with an orbit of rotation of the blade of the agitator 35 as shown in FIG. 4, the amount of toner that is not moved but remains inside the container body 31 can be reduced.

As shown in FIG. 4, a communicating opening 102*a* is formed in the intermediate cover 102 to which each toner cartridge 30 is attached. The communicating opening 102*a* communicates with the toner outlet 32 of the toner cartridge 30. Additionally, a receiving opening 49 is formed in an upper face of the developing device 4 in FIG. 4 to communicate with the communicating opening 102*a*. In a state in which the toner cartridge 30 is mounted to the intermediate cover 102, the toner outlet 32 of the toner cartridge 30 can communicate with the receiving opening 49 of the developing device 4 via the communicating opening 102*a*, thus enabling supply of toner from the toner cartridge 30 to the developing device 4.

Additionally, in the state in which the toner cartridge 30 is mounted, a connecting seal 50 is present between the toner outlet 32 and the communicating opening 102*a* and serves as a seal member to prevent leak of toner therefrom. Although the connecting seal 50 is provided to the intermediate cover 102 in the present embodiment, alternatively, the connecting seal 50 may be provided to the toner cartridge 30. A through hole 52 is formed in a center position of the connecting seal 50 to allow passage of toner from the toner outlet 32 to the receiving opening 49. It is to be noted that, although the connecting seal 50 is constructed of soft urethane foam, the material of the connecting seal 50 is not limited thereto.

Development operation of the above-described development device 4 is described below with reference to FIG. 4.

When the developing roller 41 and the supply roller 42 start rotating in response to a start command, the supply roller 42 supplies toner to the surface of the developing roller 41. While toner carried on the developing roller 41 passes through the nip between the developing roller 41 and the doctor blade 43, the amount of toner is adjusted. Simultaneously, toner is charged through friction. When the toner reaches the position facing the photoreceptor 2 (i.e., a development range), the toner electrostatically moves to the electrostatic latent image formed on the photoreceptor 2, thus developing it into a toner image.

Next, supply of toner to the development device 4 is described in further detail below.

When the amount of toner inside the development housing 40 falls to or below a reference amount, toner is supplied to the development device 4. Specifically, while the amount of toner inside the development housing 40 is greater than the reference amount, toner is present between the ends of the light guides 46 and 47 facing each other, blocking the light path between them. Accordingly, the light-receiving element does not receive light. When the amount of toner remaining inside the development housing 40 falls below the reference amount as the toner is consumed in image development, no toner is present between the ends of the light guides 46 and 47. Accordingly, toner can be transmitted from the light guide 46 to the light guide 47. In response to detection of transmission of light, a toner supply command is generated.

Upon the toner supply command, the conveying screw 34 inside the toner cartridge 30 rotates. Then, toner is conveyed to the toner outlet 32 and supplied through the toner outlet 32 to the first compartment E1 inside the development housing 40. Additionally, in the present embodiment, the agitator 35 starts rotating simultaneously with rotation of the conveying screw 34 in the toner cartridge 30. As the agitator 35 rotates, toner inside the toner cartridge 30 is agitated and conveyed toward the conveying screw 34. When the amount of toner inside the development housing 40 is increased to or greater than the reference amount with the toner supply operation, the light path between the light guides 46 and 47 is blocked, and the conveying screw 34 and the agitator 35 are stopped. Thus, toner supply is completed.

Meanwhile, when toner is thus supplied, in the development housing 40, the conveying screws 44 and 45 start rotating and conveying toner in the opposite directions in the first and second compartments E1 and E2, respectively. When the toner reaches downstream end portions in the first and second compartments E1 and E2 in the direction which the toner is conveyed (hereinafter "toner conveyance direction"), the toner is forwarded to the other compartment E1 or E2 through the opening 48*a* formed in the either end portion of the partition 48. Then, toner is conveyed in the compartment E1 or E2 toward the opposite end and returned through the opening 48*a* to the compartment E1 or E2 where the toner is present originally. By repeating this operation, the toner can be circulated between the first compartment E1 and the second compartment E2, and the supplied toner can be mixed with the toner existing in the development housing 40.

Thus, while toner is circulated inside the development housing 40, the ratio of fresh toner in the toner inside the development housing 40 can become uniform, thus reducing color unevenness and scattering of toner in the background of output images.

Descriptions are given below of a toner cartridge according to a first embodiment.

In toner cartridges provided with a shutter to open and close a discharge outlet formed in a container body, if clearance is present between the shutter and the container body, it is possible that toner leaks therefrom, contaminating an interior of the apparatus or the process unit. In particular, in a state in which toner agitated inside the toner cartridge floats in air, forming toner clouds, the possibility of leak of toner is higher since toner can scatter affected by airflow generated inside the apparatus.

In view of the foregoing, the following embodiments can provide a powder container, a developing unit, a process unit, and an image forming apparatus capable of inhibiting leak of toner from between the shutter and the container body. According to the embodiments described below, leak of power from the clearance between the shutter and the container body can be prevented or inhibited with a seal member.

Figure 5:
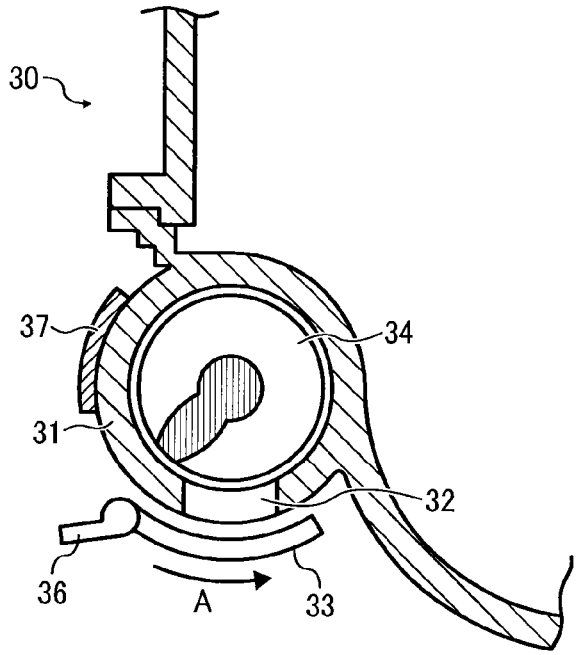
FIG. 5 is a partial cross-sectional view of the toner cartridge according to the first embodiment, in which a shutter thereof is closed.
Figure 6:
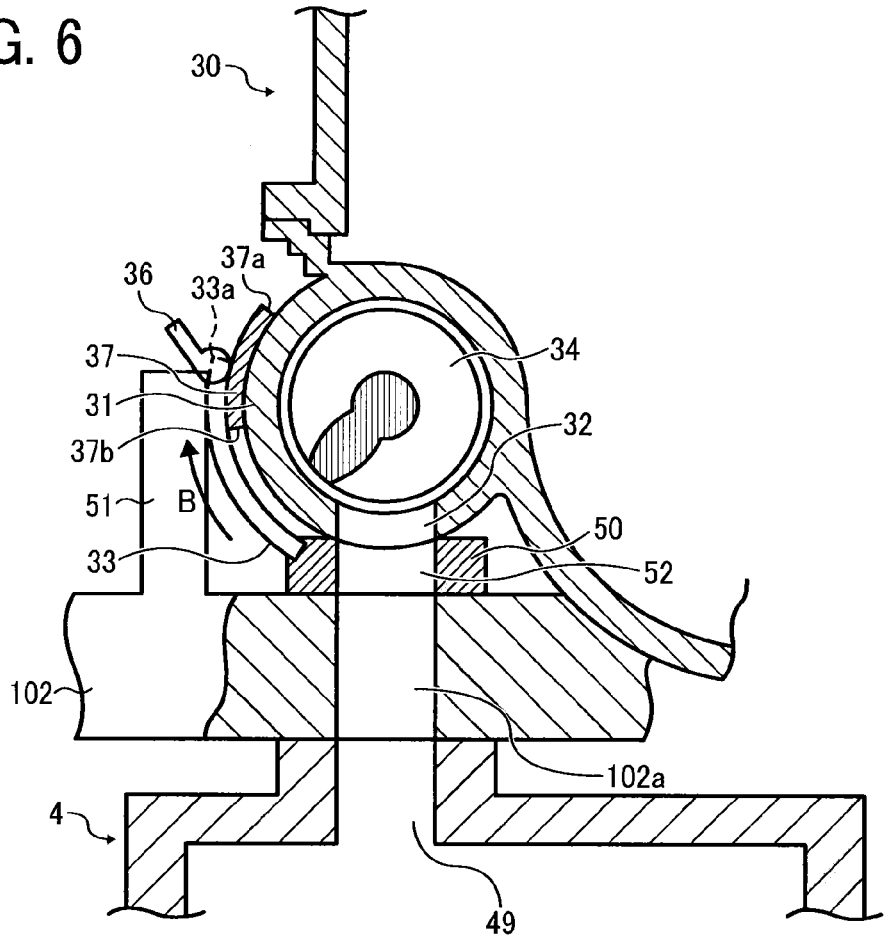
FIG. 6 is a partial cross-sectional view in which the shutter according to the first embodiment is open.

FIG. 5 is a cross-sectional view of the shutter 33 of the toner cartridge 30 being at a position to close the toner outlet 32 (hereinafter "closed position"), according to the first embodiment. FIG. 6 is a cross-sectional view of the shutter 33 being at a position to keep the toner outlet 32 open (hereinafter "open position").

The shutter 33 is arc-shaped in cross section as shown in FIGS. 5 and 6. The shutter 33 is rotatable along the arc-shaped outer circumference of the container body 31 so that the position thereof is switched between the closed position to close the toner outlet 32 and the open position to open the toner outlet 32. It is to be noted that the type of movement of the shutter 33 is not limited to rotation. Alternatively, when the outer face of the container body 31 adjacent to the toner outlet 32 is, for example, planar, the shutter 33 may move linearly along the planar outer face.

Referring to FIG. 5, in a state in which the toner cartridge 30 is disengaged from the intermediate cover 102, the shutter 33 is urged by a bias member, such as a spring, in the direction indicated by arrow A shown in FIG. 5 (hereinafter "closing direction A") to close the toner outlet 32. By contrast, when the toner cartridge 30 is mounted to the intermediate cover 102, a projection 51 projecting from the intermediate cover 102 contacts a projection 36 of the shutter 33. Then, the shutter 33 rotates in the direction indicated by arrow B shown in FIG. 6 (hereinafter "opening direction B") and opens the toner outlet 32.

Further, a seal member 37 is provided to an outer face of the container body 31 of the toner cartridge 30 as shown in FIG. 5. The seal member 37 can be constructed of, for example, soft urethane foam, but the material of the seal member 37 is not limited thereto.

The seal member 37 is disposed corresponding to the open position of the shutter 33. Specifically, as shown in FIG. 6, when the position of the shutter 33 is switched to the open position, the seal member 37 is interposed between the shutter 33 and the container body 31. The seal member 37 being in this state contacts or presses against an inner face of the shutter 33 and the outer face of the container body 31, thus sealing the clearance between the shutter 33 and the container body 31.

Additionally, in the state shown in FIG. 6, a downstream end 37*a* of the seal member 37 in the opening direction B is positioned downstream from a downstream end 33*a* of the shutter 33 in that direction. That is, the seal member 37 is disposed to project downstream in the opening direction B beyond the downstream end 33*a* of the shutter 33 being at the open position. By contrast, an upstream end 37*b* of the seal member 37 in the opening direction B is disposed between the container body 31 and the shutter 33 being at the open position.

Generally, when the toner cartridge 30 is mounted to the intermediate cover 102, as shown in FIG. 6, the connecting seal 50 contacts the outer periphery of the toner outlet 32, thereby eliminating clearance around the periphery of the toner outlet 32. Thus, toner does not leak between the outer periphery of the toner outlet 32 and the connecting seal 50.

Figure 7:
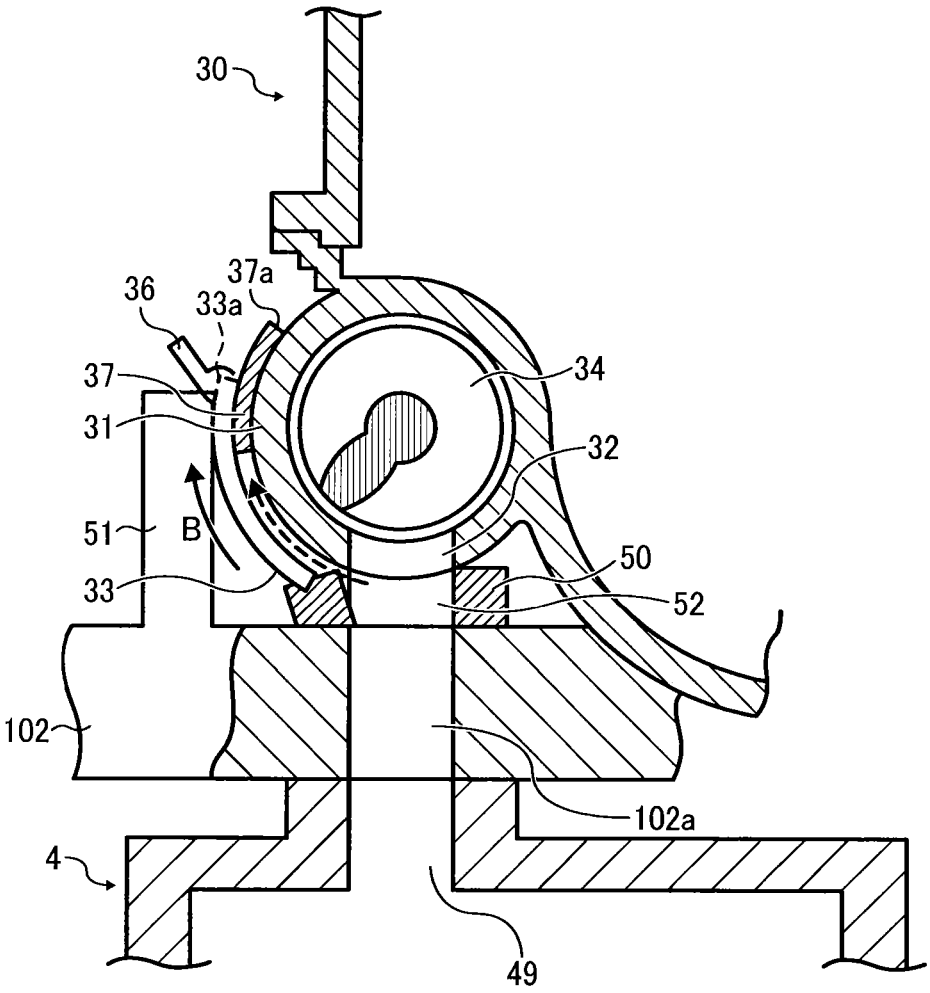
FIG. 7 illustrates a state in which a seal member (i.e., connecting seal) provided to a discharge outlet is inclined, allowing clearance between an outer periphery of the discharge outlet and the seal member.

While the shutter 33 moves to the open position, however, the shutter 33 slides on the connecting seal 50, and the connecting seal 50 is tilted as shown in FIG. 7. Thus, it is possible that clearance is created between the outer periphery of the toner outlet 32 and the connecting seal 50. In this case, as indicated by a broken arrow shown in FIG. 7, it is possible that toner may enter the clearance between the shutter 33 and the container body 31.

By contrast, in the present embodiment, the seal member 37 can seal the clearance between the shutter 33 and the container body 31, thus preventing or inhibiting leak of toner therefrom. In particular, the sealing capability can be enhanced by the arrangement in which the downstream end 37*a* of the seal member 37 in the opening direction B is downstream from the downstream end 33*a* of the shutter 33. With this configuration, toner can be prevented or inhibited from leaking outside even in the state in which toner floats in air and forms toner clouds, caused by, for example, agitation of the agitator 35 during printing operation.

Figure 8:
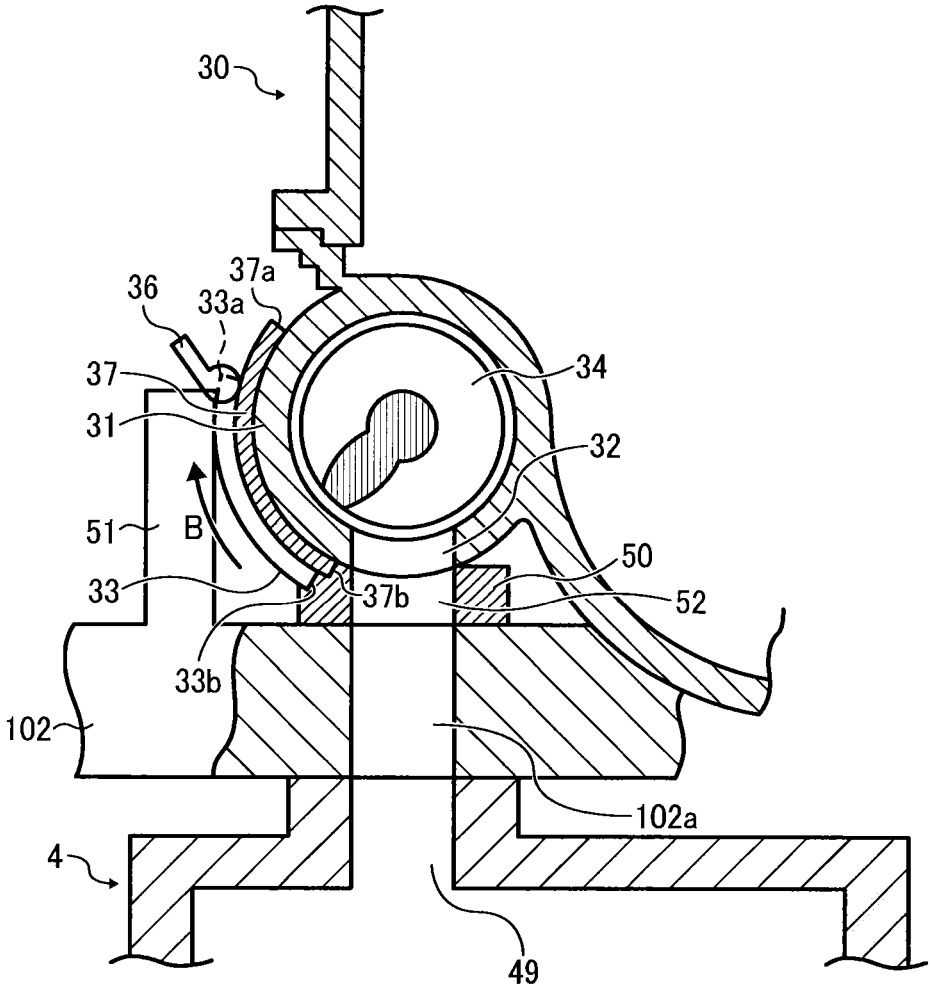
FIG. 8 is a cross-sectional view illustrating a configuration of a toner cartridge according to a second embodiment.

FIG. 8 is a cross-sectional view of a toner cartridge according to a second embodiment.

In addition to the position of the downstream end 37*a* of the seal member 37 according to the first embodiment, the second embodiment has the feature shown in FIG. 8. That is, in the state in which the shutter 33 is at the open position, the upstream end 37*b* is positioned upstream from an upstream end 33*b* of the shutter 33 in the opening direction B. That is, in the state shown in FIG. 8, the seal member 37 is disposed to project upstream in the opening direction B beyond the upstream end 33*b* of the shutter 33 in the opening direction B.

This configuration can prevent or inhibit toner or toner clouds from entering the clearance between the shutter 33 and the container body 31, and toner can be better prevented or inhibited from leaking outside.

Figure 9:
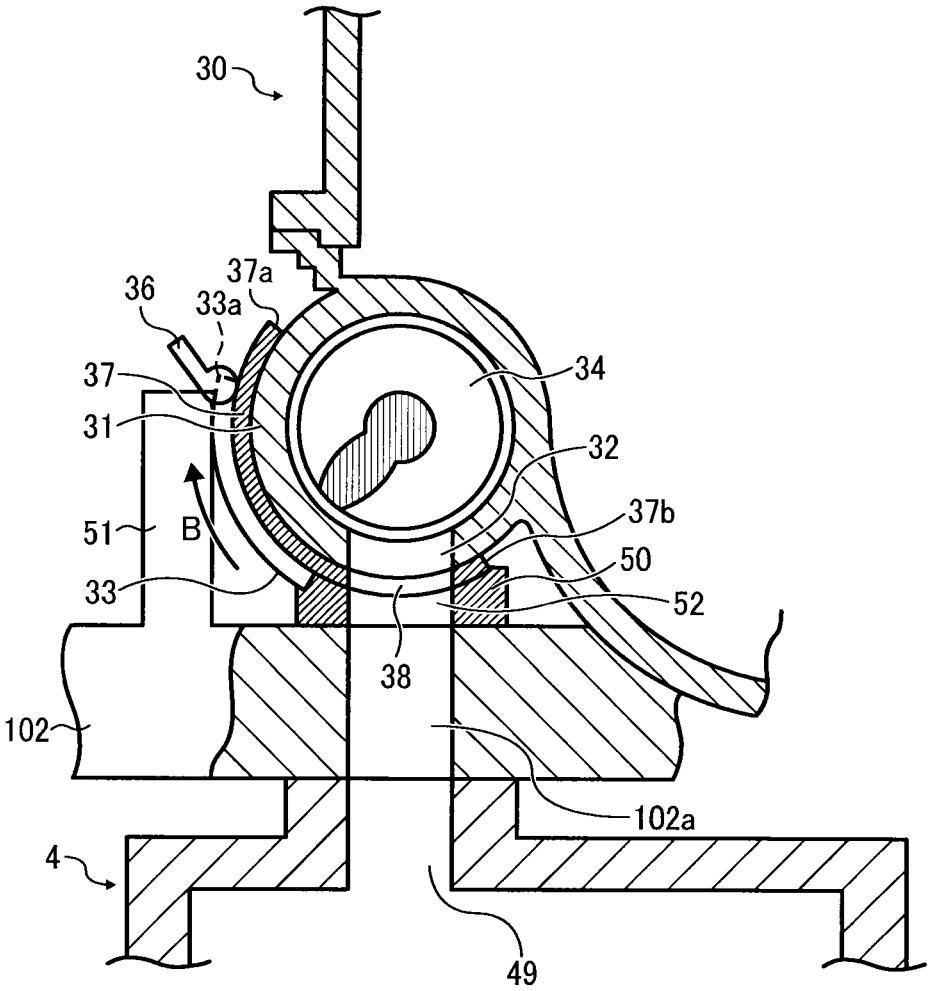
FIG. 9 is a cross-sectional view illustrating a configuration of a toner cartridge according to a third embodiment.

FIG. 9 is a cross-sectional view of a toner cartridge according to a third embodiment.

In the third embodiment, the seal member 37 is extended further upstream in the opening direction B so that the upstream end 37*b* is positioned upstream beyond the toner outlet 32 in the opening direction B as shown in FIG. 9. In this configuration, additionally a through hole 38 is formed in the seal member 37 at the position corresponding to the toner outlet 32 to communicate with the toner outlet 32.

Figure 10:
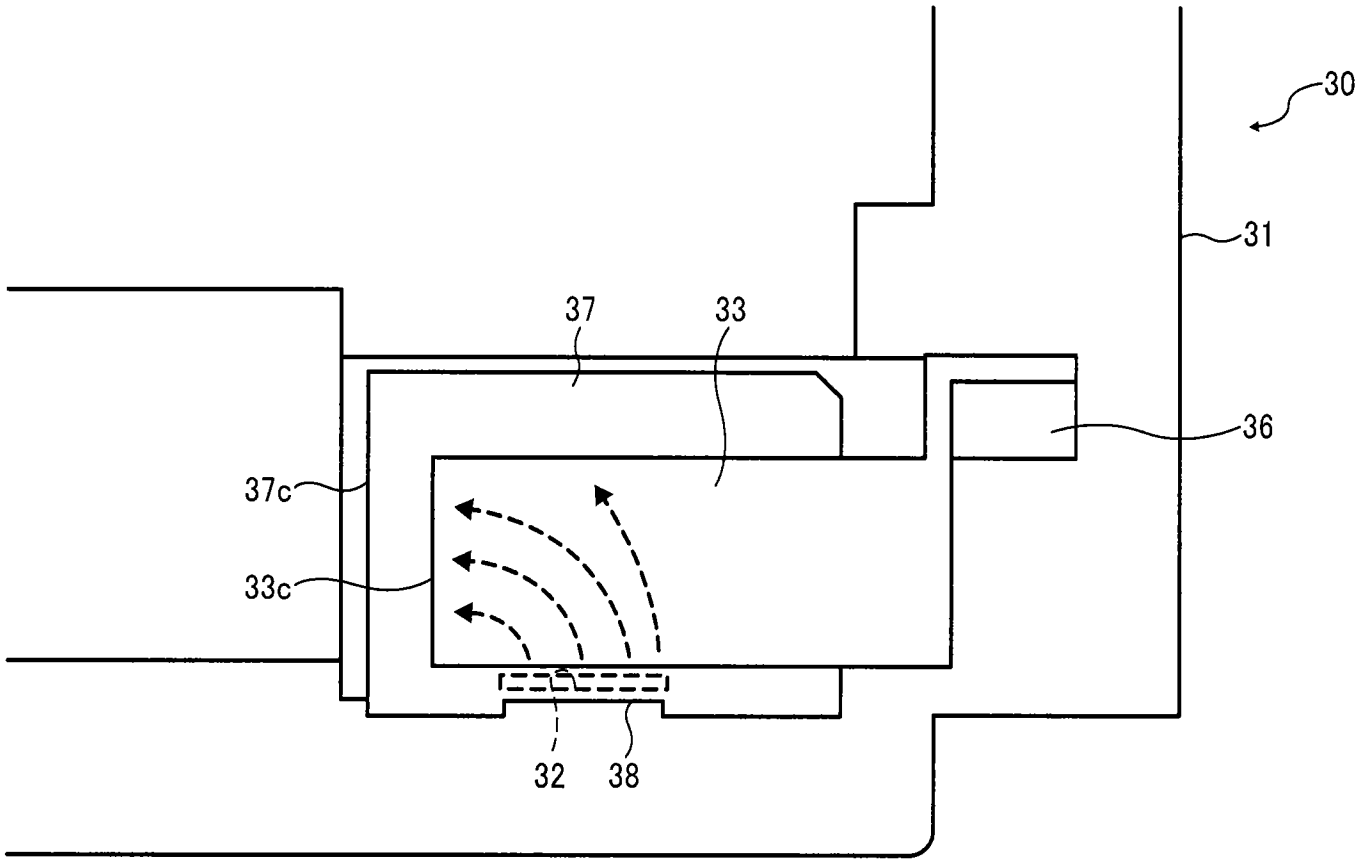
FIG. 10 illustrates the toner cartridge according to the third embodiment, as viewed from the left in FIG. 9.

FIG. 10 illustrates the toner cartridge according to the third embodiment, as viewed from the left in FIG. 9.

In FIG. 10, broken arrows indicate the route of toner leaking from the toner outlet 32 in a state without the seal member 37. In this case, the toner leaking from the toner outlet 32 moves to the left in FIG. 10, affected by airflow generated inside the apparatus.

Therefore, in the third embodiment, a side end 37*c* (on the left in FIG. 10) of the seal member 37 projects to the left in FIG. 10 beyond a side end 33*c* of the shutter 33 on the same side as the side end 37*c*. In other words, in a state in which the shutter 33 is disposed at the open position, the side end 37*c* of the seal member 37 in a direction crossing or perpendicular to the opening direction B of the shutter 33 (or the rotation axis of the shutter 33) is outside the side end 33*c*.

With this arrangement, the toner moving due to the effect of the airflow can be prevented or inhibited from leaking outside by the seal member 37. Additionally, although not shown in the figures, when toner leaking from the toner outlet 32 moves to the right in FIG. 10, the seal member 37 is designed so that the other side end (on the right in FIG. 10) of the seal member 37 projects beyond (outside in the lateral direction in FIG. 10) a right end of the shutter 33.

Descriptions are given below of a fourth embodiment in which any of the above-described embodiments is adopted into a toner cartridge incorporating a double-shutter structure with reference to FIG. 11.

Figure 11:
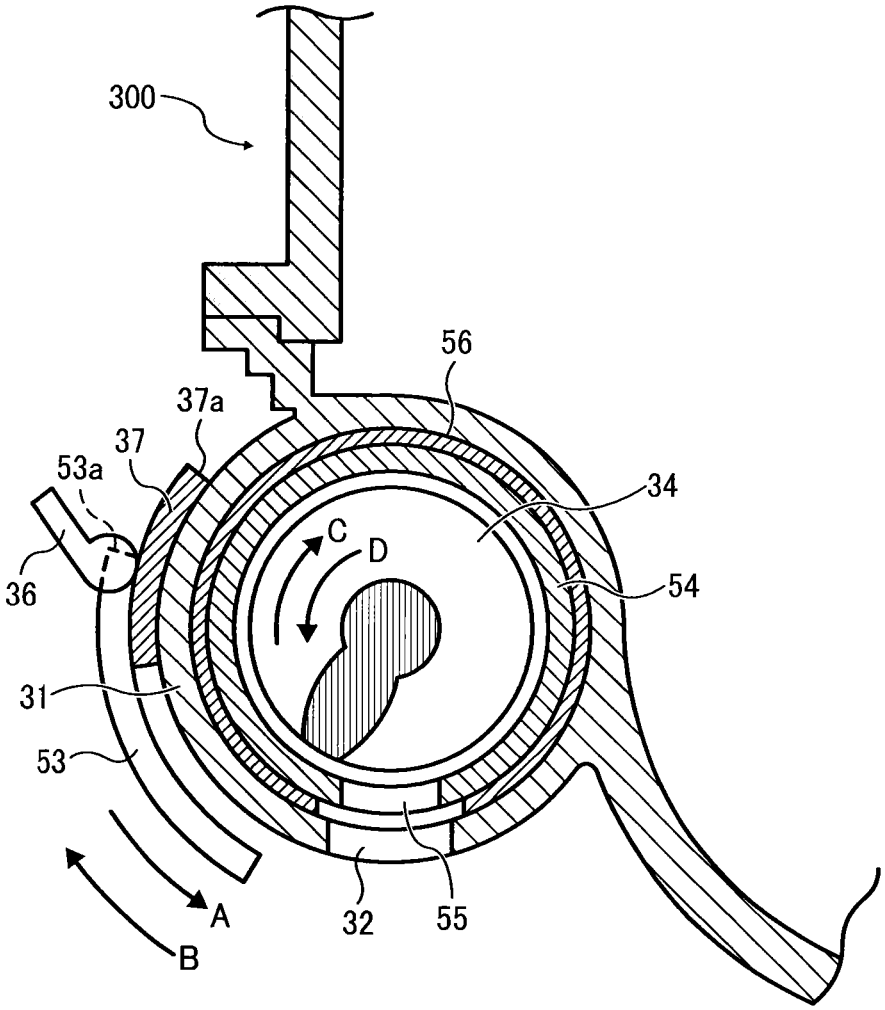
FIG. 11 illustrates a toner cartridge according to a fourth embodiment, employing a double-shutter structure.

A toner cartridge 300 shown in FIG. 11 includes a container body 31 in which a toner outlet 32 is formed, an outer shutter 53 disposed outside the toner outlet 32, and an inner shutter 54 disposed inside the toner outlet 32. The outer shutter 53 has a configuration similar to that of the shutter 33 in the above-described embodiments and movable in the directions indicated by arrows A and B shown in FIG. 11 along the outer circumference of the container body 31. By contrast, the inner shutter 54 is cylindrical and rotatable. An opening 55 is formed in the inner shutter 54, extending partly in the circumferential direction. The opening 55 penetrates the inner shutter 54 in the direction of diameter. The inner shutter 54 can rotate around a shaft center thereof in the directions indicated by arrows C and D shown in FIG. 11 and move to an open position, at which the opening 55 faces the toner outlet 32, and a closed position, at which the opening 55 is away from the open position. Further, an inner seal 56 is provided between the inner shutter 54 and an inner face of the container body 31 to prevent or inhibit leak of toner.

In the toner cartridge 300 employing the above-described double-shutter structure, leak of toner can be prevented or inhibited similarly by incorporating the above-described arrangements in a state in which the outer shutter 53 is at the open position: 1) the seal member 37 is provided between the outer shutter 53 and the container body 31; and 2) the downstream end 37*a* of the seal member 37 in the opening direction B of the outer shutter 53 is positioned downstream from a downstream end 53*a* of the outer shutter 53 in the opening direction B.

It is to be noted that, although the seal member 37 in the configuration shown in FIG. 11 is similar to that of the first embodiment shown in FIG. 6, alternatively, the seal member 37 shown in FIG. 8 according to the second embodiment or the seal member 37 shown in FIGS. 9 and 10 according to the third embodiment can be adopted into the toner cartridge 300 shown in FIG. 11.

Figure 12:
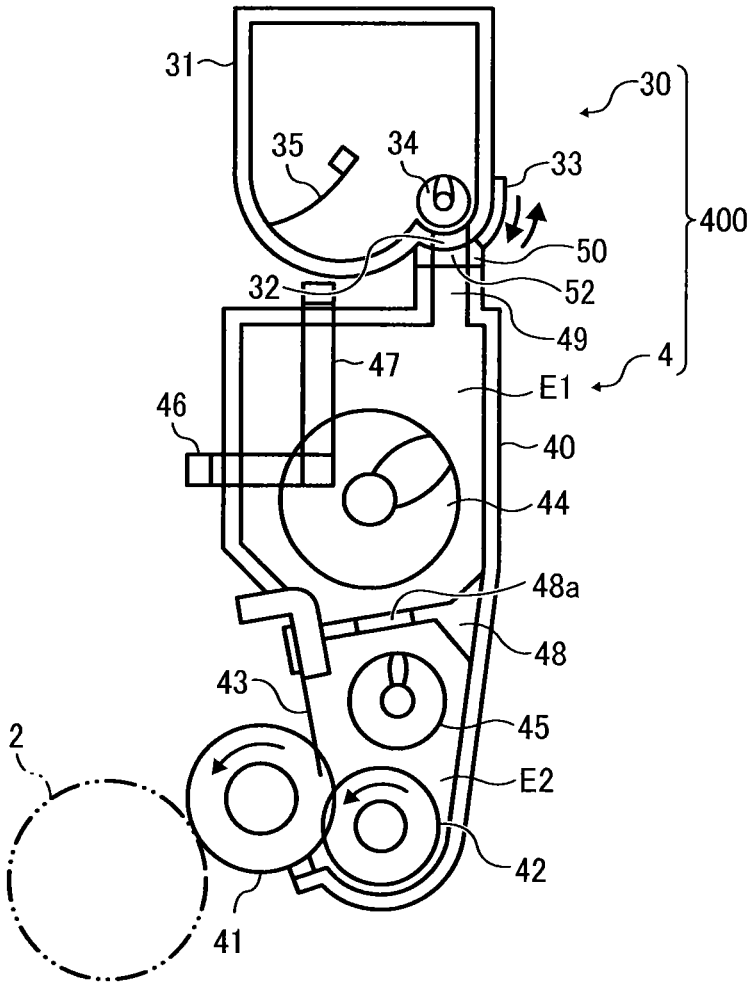
FIG. 12 is a schematic cross-sectional view of a developing unit according to an embodiment.

Additionally, the toner cartridge 30 according to any of the first through third embodiments and the toner cartridge 300 according to the fourth embodiments (hereinafter collectively "toner cartridges 30") may be united with at least one of the developing device 4, the photoreceptor 2, and the like into a single modular unit, a process unit, to be replaced entirely. Yet additionally, as shown in FIG. 12, the toner cartridge 30 according to any of the first through fourth embodiments may be configured to connect to the developing device 4, without the intervening intermediate cover 102, into a developing unit 400 so that the toner cartridge 30 and the developing device 4 can be replaced at a time.

Figure 13:
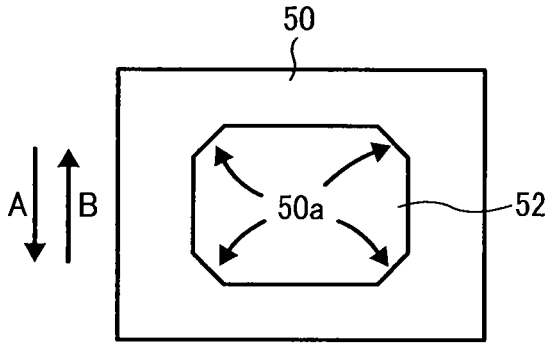
FIG. 13 is a plan view of the seal member according to an embodiment.

FIG. 13 is a plan view of the connecting seal 50 applicable to any of the above-described first through fourth embodiments.

Although the connecting seal 50 shown in FIG. 13 has a quadrangular outer face (outer circumference), an inner face (inner circumference) thereof enclosing the through hole 52 is octagonal. The octagonal inner face is advantageous over, for example, a quadrangular inner face in that localization of stress at each corner 50*a* can be alleviated. Specifically, while the shutter 33 moves in the closing direction A or the opening direction B, shearing force in the closing direction A or the opening direction B acts on the connecting seal 50 due to sliding contact. However, localization of stress at each corner 50*a* can be alleviated when the corner 50*a* has an internal angle greater than 90°. This configuration can alleviate damage to the connecting seal 50 and secure the sealing capability for a long time.

It is to be noted that the inner circumferential shape of the connecting seal 50 may be another polygon having an internal angle (angle of aperture) greater than 90°.

Figure 14:
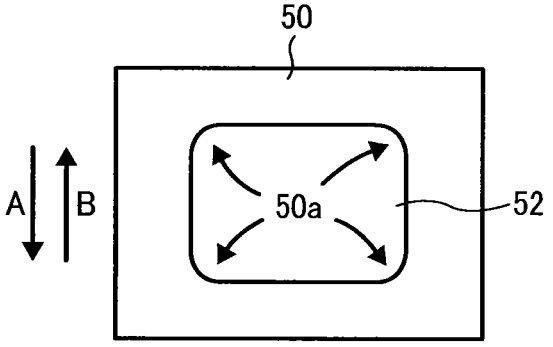
FIG. 14 illustrates a variation of the seal member.

Alternatively, as shown in FIG. 14, localization of stress at each corner 50*a* on the inner circumference of the connecting seal 50 can be alleviated when the corner 50*a* is constructed of a curved face. Yet alternatively, the configurations shown in FIGS. 13 and 14 may be combined, and each corner 50*a* on the inner circumference of the connecting seal 50 may be either curved or has an angle of aperture greater than 90°.

Table 1 shows results of a test executed to ascertain the effects of the seal member 37 and the connecting seal 50 according to above-described embodiments.

TABLE 1

| | Connecting seal | Inner circumference of seal | Toner contamination |
|---|---|---|---|
| 1 | Not used | Quadrangle | Unacceptable |
| 2 | Not used | Octagonal | Acceptable |
| 3 | First embodiment shown in FIG. 6 | Quadrangle | Acceptable |
| 4 | Second embodiment shown in FIG. 8 | Quadrangle | No contamination |
| 5 | Second embodiment shown in FIG. 8 | Octagonal | No contamination |

In the test, five different test configurations 1 through 5 shown in table 1 were used.

It is to be noted that the shutter in the description blow, concerning the test results, can be shutter 33 shown in FIG. 6 and the like or the double-shutter structure shown in FIG. 11.

Specifically, the test configuration 1 is a comparative example, in which the seal member 37 is not provided between the container body 31 of the toner cartridge and the shutter 33 and the seal member 37 has a quadrangle inner shape.

In the test configuration 2, the seal member 37 is not provided, but the connecting seal 50 has a octagonal inner shape as shown in FIG. 13.

By contrast, the test configuration 3 includes the seal member 37 shown in FIG. 6, according to the first embodiment, provided between the container body 31 and the shutter 33. The connecting seal 50 has a quadrangular inner shape.

The test configuration 4 includes the seal member 37 shown in FIG. 8, according to the second embodiment, provided between the container body 31 and the shutter 33. The connecting seal 50 has a quadrangular inner shape.

The test configuration 5 includes, similarly to the test configuration 4, the seal member 37 shown in FIG. 8. The connecting seal 50 has a octagonal inner shape as shown in FIG. 13. It is to be noted that soft urethane foam was used as the material of the seal member 37 and the connecting seal 50 in the test configurations 1 through 5.

In the test configurations 1 through 5, after the developing device 4 was operated 180 seconds consecutively, contamination with toner inside the image forming apparatus was checked. The conveying screws 44 and 45 were rotated at 140 revolutions per minute (rpm) inside the developing device 4 to agitate toner therein. Contamination with toner was evaluated in three levels of "Unacceptable" meaning that contamination was noticeable; "Acceptable" meaning that there was slight contamination; and "No contamination".

According to the test results, contamination with toner was observed and unacceptable in the test configuration 1 (comparative example). It can be known from the result that toner leaks from the clearance between the shutter 33 and the container body 31 since the seal member 37 is not provided. Additionally, it can be deemed that toner leaks since the inner shape of the connecting seal 50 is quadrangular, with which stress can be localized easily.

In the test configuration 2, although the seal member 37 was not provided similarly to the test configuration 1, the mount of contamination with toner was smaller and acceptable. It can be deemed that toner leak can be suppressed since the inner shape of the connecting seal 50 is octagonal, with which localization of stress can be alleviated.

In the test configuration 3, the mount of contamination with toner was smaller and acceptable. It can be known from the result that toner leak can be suppressed by the seal member 37 provided between the shutter 33 and the container body 31 better than the test configuration 1 although the inner circumferential shape of the connecting seal 50 is similar to that of the test configuration 1.

In the test configuration 4, toner leak was not observed. It can be deemed that the sealing capability is higher, thus inhibiting toner leak better, since the seal member 37 in the test configuration 4 extends more to the upstream side in the opening direction B of the shutter 33 compared with the test configuration 3.

In the test configuration 5 using the seal member 37 similar to that used in the test configuration 4, toner leak was not observed.

As described above, according to the above-described embodiments, leak of toner can be prevented or inhibited by using the following arrangements in the state in which the shutter 33 is at the open position: 1) the seal member 37 is provided, at least partly, between the shutter 33 and the container body 31; and 2) the downstream end 37*a* of the seal member 37 in the opening direction B of the shutter 33 is positioned downstream from the downstream end 33*a* of the shutter 33 in the opening direction B. With this configuration, toner leak can be inhibited during replacement of the toner cartridge 30 or printing operation, thus inhibiting contamination with toner inside the image forming apparatus.

Additionally, toner leak can be better prevented or inhibited by disposing the upstream end 37*b* of the seal member 37 upstream from the upstream end 33*b* of the shutter 33 in the opening direction B in the state in which the shutter 33 is at the open position.

Additionally, regarding the connecting seal 50, when the corner on the inner circumference of the connecting seal 50 has a shape shown in FIG. 13 or 14, localization of stress can be alleviated and damage to the connecting seal 50 can be reduced. Thus, the sealing capability can be secured for a long time.

It is to be noted that, in the descriptions above, it will be understood that if an element or layer is referred to as being "on," "against," "connected to" or "coupled to" another element or layer, then it can be directly on, against, connected, or coupled to the other element or layer, or intervening elements or layers may be present. In contrast, if an element is referred to as being "directly on", "directly connected to" or "directly coupled to" another element or layer, then there are no intervening elements or layers present.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

Numerous additional modifications and variations are possible in light of the above teachings. It is therefore to be understood that, within the scope of the appended claims, the disclosure of this patent specification may be practiced otherwise than as specifically described herein.

What is claimed is:

1. A powder container comprising:

a container body to contain powder for image formation;

a discharge outlet formed in the container body to discharge the powder therefrom;

a shutter movable between an open position to open the discharge outlet and a closed position to close the discharge outlet; and a seal which is fixed on an outer face of the container body, the seal to be interposed between the container body and the shutter when the shutter is at the open position, wherein, in an opening direction of the shutter in which the shutter moves to open the discharge outlet, a downstream end of the seal is positioned downstream from a downstream end of the shutter being at the open position.

2. The powder container according to claim 1, wherein, in the opening direction of the shutter, an upstream end of the seal is positioned upstream from an upstream end of the shutter being at the open position.

3. The powder container according to claim 1, wherein, in a direction perpendicular to the opening direction of the shutter, an end of the seal projects outward beyond an end of the shutter being at the open position.

4. The powder container according to claim 1, wherein the shutter is movable along an outer face of the container body between the open position and the closed position.

5. The powder container according to claim 1, wherein the shutter is arc-shaped in cross section and the shutter is rotatable along an arc-shaped outer circumference of the container body.

6. The powder container according to claim 1, wherein the seal seals a clearance between the container body and the shutter when the shutter is at the open position.

7. An image forming apparatus comprising:

a latent image bearer to bear a latent image;

a developing device to supply powder for image formation to the latent image formed on the latent image bearer; and the powder container according to claim 1.

8. The image forming apparatus according to claim 7, wherein the powder container and the developing device are united together into a developing unit and replaceable together at a time.

9. The image forming apparatus according to claim 7, wherein the powder container, the latent image bearer, and the developing device are united together into a process unit that is removably installable in an apparatus body of the image forming apparatus.

10. A developing unit comprising:

a developing device to supply powder for image formation to a latent image formed on a latent image bearer; and a powder container including:

a container body to contain the powder;

a discharge outlet formed in the container body to discharge the powder therefrom;

a shutter movable between an open position to open the discharge outlet and a closed position to close the discharge outlet; and a seal which is fixed on an outer face of the container body, the seal to be interposed between the container body and the shutter when the shutter is at the open position, wherein, in an opening direction of the shutter in which the shutter moves to open the discharge outlet, a downstream end of the seal is positioned downstream from a downstream end of the shutter being at the open position.

11. The developing unit according to claim 10, further comprising a connecting seal via which the discharge outlet of the powder container is connectable to a receiving opening formed in the developing device, wherein the shutter slidingly contacts the connecting seal when the shutter moves from the closed position to the open position.

12. The developing unit according to claim 10, wherein the seal seals a clearance between the container body and the shutter when the shutter is at the open position.

13. The developing unit according to claim 11, wherein a through hole is formed at a center position of the connecting seal to allow the powder to move from the discharge outlet to the receiving opening, and each corner on an inner circumference of the connecting seal enclosing the through hole has an angle of aperture greater than 90°.

14. The developing unit according to claim 11, wherein a through hole is formed at a center position of the connecting seal to allow the powder to move from the discharge outlet to the receiving opening, and each corner on an inner circumference of the connecting seal enclosing the through hole is curved.

15. A process unit removably installable in an apparatus body of an image forming apparatus, the process unit comprising:

a latent image bearer to bear a latent image;

a developing device to supply powder for image formation to the latent image; and a powder container including:

a container body to contain the powder;

a discharge outlet formed in the container body to discharge the powder therefrom;

a shutter movable between an open position to open the discharge outlet and a closed position to close the discharge outlet; and a seal which is fixed on an outer face of the container body, the seal to be interposed between the container body and the shutter when the shutter is at the open position, wherein, in an opening direction of the shutter in which the shutter moves to open the discharge outlet, a downstream end of the seal is positioned downstream from a downstream end of the shutter being at the open position.

16. The process unit according to claim 15, wherein, in the opening direction of the shutter, an upstream end of the seal is positioned upstream from an upstream end of the shutter being at the open position.

17. The process unit according to claim 15, wherein, in a direction perpendicular to the opening direction of the shutter, an end of the seal projects outward beyond an end of the shutter being at the open position.

18. The process unit according to claim 15, wherein the shutter is movable along an outer face of the container body between the open position and the closed position.

19. The process unit according to claim 15, wherein the shutter is arc-shaped in cross section and the shutter is rotatable along an arc-shaped outer circumference of the container body.

20. The process unit according to claim 15, wherein the seal seals a clearance between the container body and the shutter when the shutter is at the open position.

* * * * *